US006991406B2

(12) United States Patent
Bodegom

(10) Patent No.: US 6,991,406 B2
(45) Date of Patent: Jan. 31, 2006

(54) METHOD AND APPARATUS FOR CONSOLIDATING EARTH STRATA

(76) Inventor: Dirk Albertus Bodegom, Meidoornstraat 18, 2861 VJ Bergambacht (NL)

( * ) Notice: Subject to any disclaimer, the term of this patent is extended or adjusted under 35 U.S.C. 154(b) by 13 days.

(21) Appl. No.: 10/725,960

(22) Filed: Dec. 2, 2003

(65) Prior Publication Data

US 2004/0156685 A1 Aug. 12, 2004

Related U.S. Application Data

(63) Continuation of application No. 09/968,599, filed on Oct. 1, 2001, now Pat. No. 6,655,873.

(30) Foreign Application Priority Data

Oct. 4, 2000 (NL) ..... 1016329

(51) Int. Cl.
*E02F 5/00* (2006.01)

(52) U.S. Cl. ..... 405/174

(58) Field of Classification Search ..... 172/740; 37/317, 319, 321, 322, 323; 404/2, 3, 73–75, 404/81–107; 405/38, 50, 174, 176
See application file for complete search history.

(56) References Cited

U.S. PATENT DOCUMENTS 4,142,817 A * 3/1979 Lazure ..... 405/174
4,643,615 A * 2/1987 Pelsy ..... 405/175
4,806,043 A * 2/1989 Fournier ..... 404/2

FOREIGN PATENT DOCUMENTS

| | | |
|---|---|---|
| CH | 486607 | 4/1970 |
| EP | 0870874 A1 | 10/1998 |
| FR | 2 448 842 | 9/1980 |
| GB | 1 384 678 | 2/1975 |
| GB | 1 392 800 | 4/1975 |
| JP | 03013617 | 1/1991 |
| JP | 08269937 | 10/1996 |
| JP | 11131465 | 5/1999 |
| JP | 2000104242 | 4/2000 |
| SU | 446598 | 12/1974 |
| SU | 630360 | 10/1978 |
| WO | WO 81/03354 | 11/1981 |
| WO | WO98/02616 | 1/1998 |
| WO | WO 00/50696 | 8/2000 |

* cited by examiner

*Primary Examiner*—Robert E. Pezzuto
(74) *Attorney, Agent, or Firm*—Garvey, Smith, Nehrbass & Doody, L.L.C.; Charles C. Garvey, Jr.

(57) ABSTRACT

Method for consolidating an earth stratum situated in a subgrade by withdrawing water that is present in there from it, comprising the stepwise arrangement from the surface of the soil, at some depth, of vertical drain, such as drains, in the earth stratum, the arrangement of horizontal drainage provided by a drainage pipe or pipes, in the upper area of the earth stratum and connecting them to the vertical drain for water transfer between them, the arrangement of an air sealing layer directly over the horizontal drainage pipes and the closing of the surface of the soil, as well as the connection of the horizontal drainage pipes to a pump for discharge of the water.

23 Claims, 10 Drawing Sheets

METHOD AND APPARATUS FOR CONSOLIDATING EARTH STRATA

This application is a continuation of application Ser. No. 09/968,599, filed Oct. 1, 2001 now U.S. Pat. No. 6,655,873.

CROSS-REFERENCE TO RELATED APPLICATIONS

Priority of Dutch patent application no. 1016329, filed in the Netherlands on 4 Oct. 2000, is hereby claimed. That patent application is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Field of the Invention

The present invention relates to a method and apparatus for consolidating earth strata.

U.S. Pat. Nos. 4,471,540; 4,643,615; and 6,254,308; International Publication No. WO 00/50696; and Published Japanese Patent Application No. 10278292, published as publication no. 2000104242 on 11 Apr. 2000, are incorporated herein by reference.

When the bearing capacity of a soil is insufficient for carrying out a civil engineering project, such as the construction of a rail road or a motorway, it may be increased by forcedly driving out/withdrawing water from the weak earth strata (clay, peat). By withdrawing water the soil material will be pressed against each other and thus obtain an increased bearing capacity. As a consequence, the volume of soil body will decrease.

Forced consolidation techniques have been known for a long time. Nowadays drainage ribbons are often used, which are driven vertically into the ground with great force by means of a drive-in lance. On top of the ground level, incorporating the projecting end portions of the ribbons, a sand body is placed over which an airtight membrane is arranged. In the sand body a drainage pipe has been accommodated, to which a pump is connected, with which water and air is withdrawn from the sand body and thus from the drainage ribbons and the areas surrounding it. The weight of the sand body increases the pressure of the water to be withdrawn, in order to accelerate the process.

However, an objection is that during the forced consolidation process the terrain, due to the presence of the membrane, is not available for (preparations for) construction activities. A membrane moreover has to be bought, arranged and guarded and mostly be removed and discharged in a flow of waste material.

It is an object of the invention to improve on this. The present invention provides a method for consolidating an earth stratum situated in a subgrade by withdrawing water that is present. The method comprises the stepwise arrangement from the surface of the soil, at some depth, of vertical draining means, such as drainage strips, in the earth stratum, the arrangement of horizontal drainage means, such as drainage pipes, in the upper area of the earth stratum and connecting them to the vertical drainage means for water transfer between them, the arrangement of an air sealing layer directly over the horizontal drainage means and the closing of the surface of the soil, as well as the connection of the horizontal drainage means to a pump for discharge of the water and air. In this way the upper load relatively increases to the atmospheric pressure and the terrain is made available again for other activities. The pump may be very effectively active, as the sealing prevents drawing in of air from above the drainage means, at least reduces it to a large degree.

Preferably a trench is made from the ground surface and the vertical drainage means are arranged from the bottom of the trench. As a result the drainage means need not be pressed through an upper layer, and their length may be limited to the minimum necessary.

In an advantageous embodiment the trench is being made by means of a plough that is arranged on a device, a vertical drainage means being arranged by means of said device as well, and the horizontal drainage means are each time arranged after that until the next vertical drainage means has to be arranged. Thus both the vertical and horizontal drainage means are preferably arranged in a continuous progress of a process.

Preferably simultaneously with the arrangement of the horizontal drainage means or immediately after that, the air sealing layer is being arranged by means of the device as well, as a result of which the time of processing is further minimized.

Preferably the air sealing layer is being arranged by removing soil material from the trench walls and pressing it on the horizontal drainage means. In this way use is made of sealing material that is already present, which is particularly possible in cases of clay or loamy soil.

Alternatively the air sealing layer can be arranged by arranging a sealing foil layer or plastic material such as, for instance bentonite, on the horizontal drainage means.

Preferably the air sealing layer is arranged by means of the device.

It is further preferred that the trench is finally closed off with soil material up to approximately the original surface. Then as well no supply of extra soil material will be necessary.

In a further development of the method according to the invention the vertical drainage means are taken from a supply, and after having been arranged are separated by cutting through at a level above the trench bottom, so that the upper portion is available for contact with the preferably elongated or tubular horizontal drainage means. The cutting through preferably takes place in the device, so that a good performance is ensured.

From another aspect the invention provides an apparatus for use in forced consolidation, comprising a device provided with means for moving them in horizontal direction, over the ground surface, with means for making a trench from the ground surface down to at least just below the upper side of the earth stratum to be consolidated, with means for the stepwise supplying of a vertical drainage ribbon from a supply and driving it into the earth stratum, and means for supplying a horizontal drainage means in the trench bottom.

Preferably the device is further provided with means for cutting through the drainage ribbon at a level above the trench bottom. The means for cutting through preferably comprises a movable blade and an anvil for said blade, said blade preferably having been arranged on an arm of a lever rotatable about a horizontal center line, the other arm of said lever being connected to a vertically active hydraulic cylinder, preferably accommodated in the trench-making means. In this way a high cutting power can be achieved with low (horizontal) occupation of space, as the stroke length of the cylinder is not limited by horizontal limitations.

The trench-making means is preferably a plough, which at its rear side is provided with means for removing soil material from the trench walls and for pressing it downward, for forming an air sealing layer over the horizontal drainage means, or with means for arranging foil or bentonite, at least (initially) plastic sealing material.

Preferably, at its rear side the plough is provided with means for supplying the horizontal drainage means, particularly from a supply roll, in the trench, so that they are situated, as it were, at the free shadow side.

It is furthermore preferred that means are provided for pivoting the plough about a horizontal axis of rotation, between a trench-making active position and an upwardly tilted moving position and vice versa. On the one hand this facilitates transport, on the other hand it can promote initial penetration of the plough.

The invention will be elucidated on the basis of an exemplary embodiment shown in the attached drawings, in which:

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 3A and 3B schematically show the portion in the plough part of the FIGS. 2A–2C with which a drainage ribbon can be cut through;

DETAILED DESCRIPTION OF THE INVENTION

Figure 1:
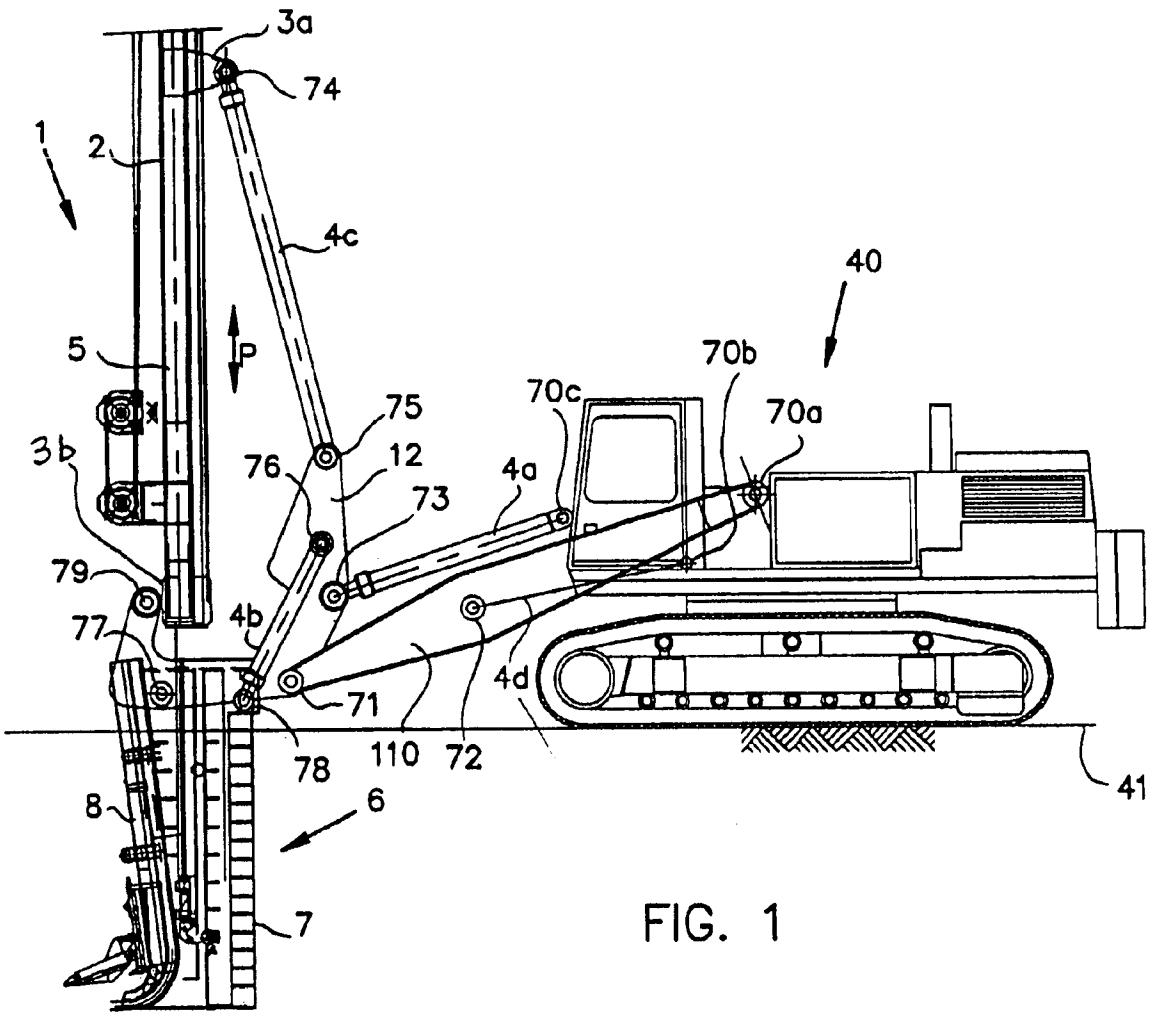
FIG. 1 is a side view of the preferred embodiment of the apparatus of the present invention.

FIG. 1 shows the preferred embodiment of the apparatus of the present invention, designated generally by the numeral 1. The apparatus 1 can include a hydraulic excavating machine 40 in order to form a kind of driving rig, which is common in driving vertical drainage ribbons into a ground. The hydraulic machine 40 is supported on ground level 41, and has an arm or boom 110 which is hinged to the machine at 70*a*. At the outer end, the arm 110 is connected to a U-shaped bracket 12 at hinge 71. A second connection is provided between machine 40 and U-shaped bracket 12 consisting of a piston/cylinder assembly 4*a* that extends between hinge 70*c* on the machine 40 and hinge 73 on the bracket 12. Hinge 73 is located above hinge 71. A further connection is provided between the arm 110 and the machine 40 with piston cylinder assembly 4*d*, in order to move the arm 110 up and down. Piston/cylinder assembly 4*d* is connected at hinge 72 to boom 110 and at hinge 70*b* to machine 40.

A kings post 2 is connected to both ends of the U-shaped bracket 12 by means of a first connection, consisting of a hinge 75, a piston/cylinder assembly 4*c*, a hinge 74 and a bracket 3*a*, located at a distance above the lower end of the post 2, and by means of a second connection, consisting of a hinge 79 and a bracket 3*b* located at the lower end of the post 2. A lance 5 is supported by the post 2 and can be moved up and down along the post 2 in the directions P by means of means that are known per se and not further shown.

Figure 4A:
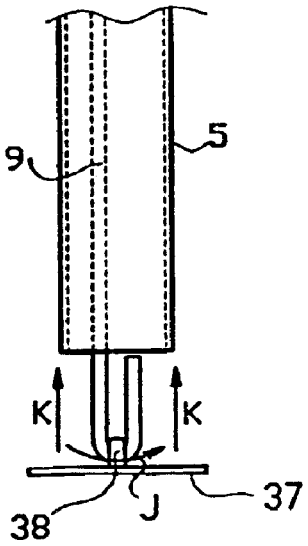
FIGS. 4A and 4B illustrate a possible way of connecting the drainage ribbon to the lance of the apparatus of FIG. 1.
Figure 4B:
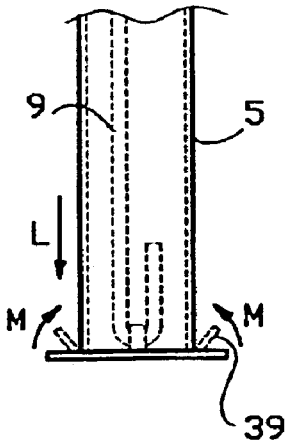

By way of background information, as illustrated in FIGS. 4A and 4B, the lower end of the lance 5 is connected to an end of drainage ribbon 9, which is unwound from a supply roll (not shown) arranged on the post 2. The lower end of the ribbon 9 is passed in the direction J through a U-bracket 38 fixed to a plate 37, and then the plate 37 is moved against the lower end of the lance 5 in the direction K. When the lance 5 is urged into the ground (direction L), the plate 37, which laterally extends from the lance 5, will bend according to arrows M to form inclined anchoring lips 39. When a length of drainage ribbon has been pressed into a ground to be consolidated by means of the lance 5, the lance 5 is lifted again. Due to the anchoring lips 39, the lower end of ribbon 9 will be held in the ground and stay in its place. The drainage ribbon will be cut through at ground level or above it after letting the lance pass upwards along the kings post, after which the new end of the drainage ribbon is connected again to the lance, for instance by means of an anchor, for a subsequent processing step.

The U-shaped bracket 12 forms a support for a plough 6 too. This plough 6, which will be described in detail, is hinged to the bracket 12 at 77, spaced apart from hinge 79. In addition, the plough 6 is connected to the bracket 12 by means of a piston/cylinder assembly 4b, which is hinged to the bracket 12 at 76 and to the plough 6 at hinge 78, between hinges 77 and 71. Hinge 76 is located between hinges 75 and 73.

The plough 6 has a front edge 7 and a rear side 8. At its lower end, the front edge 7 may be provided with a nose, but it is left out in the figures.

Figure 1A:
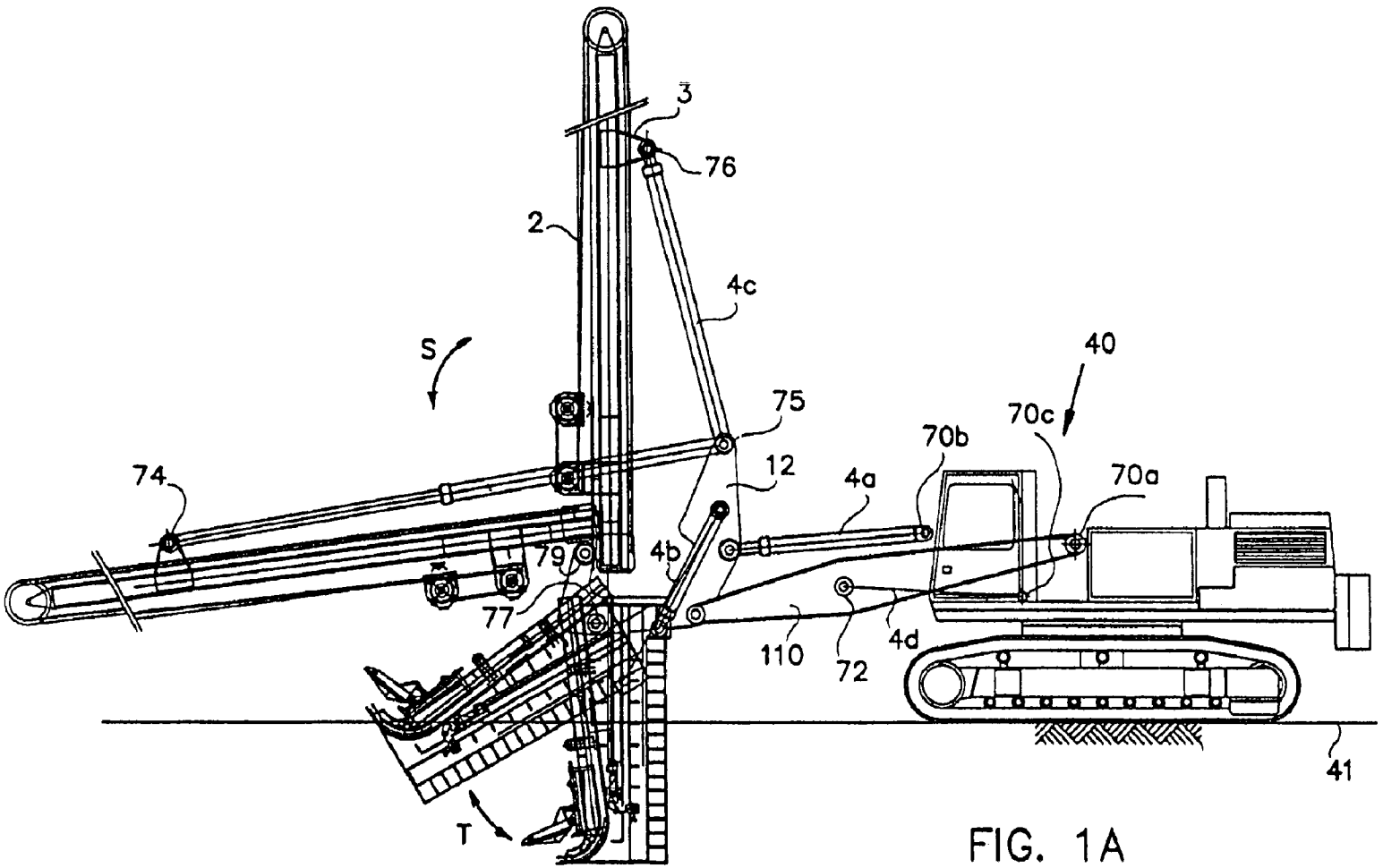
FIGS. 1A–C show several possible states of the apparatus according to FIG. 1, amongst others a fully collapsed state (FIG. 1C)
Figure 1B:
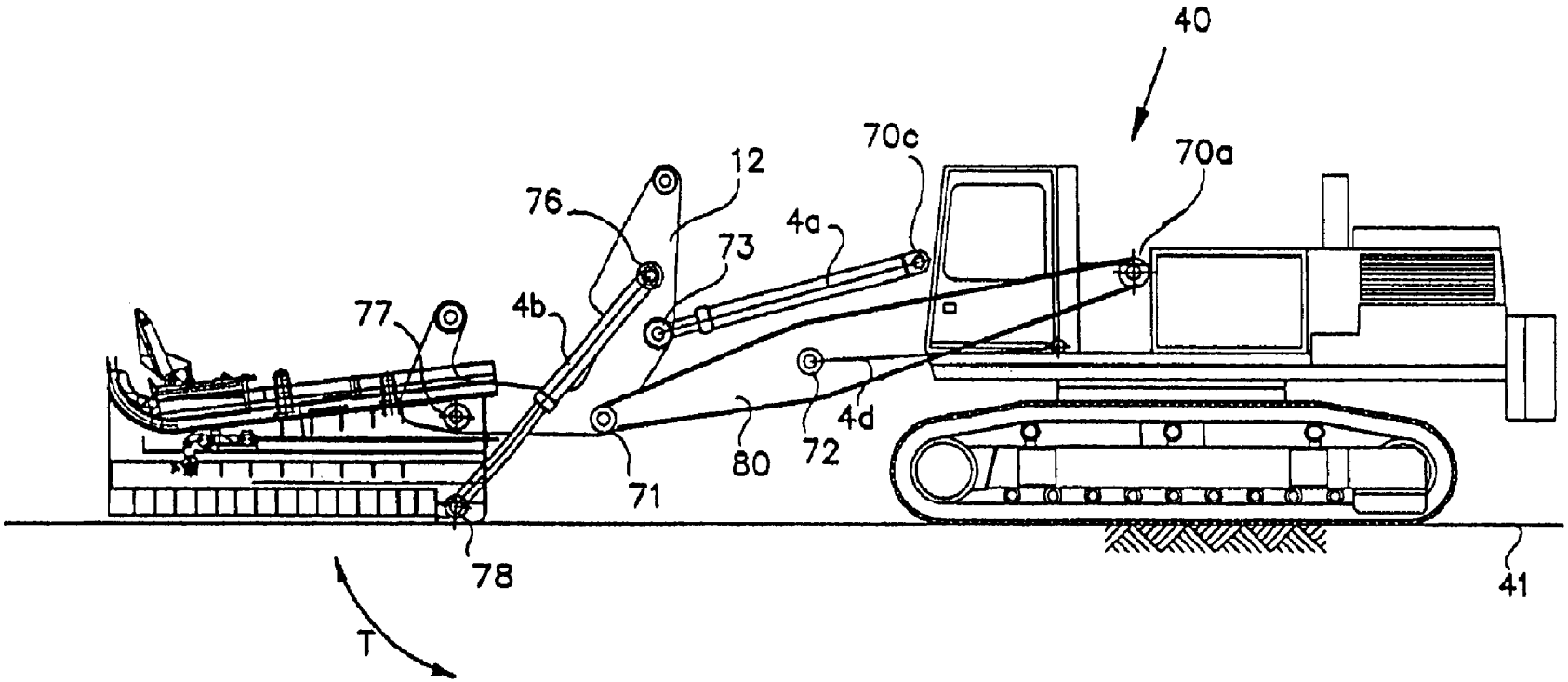
Figure 1C:
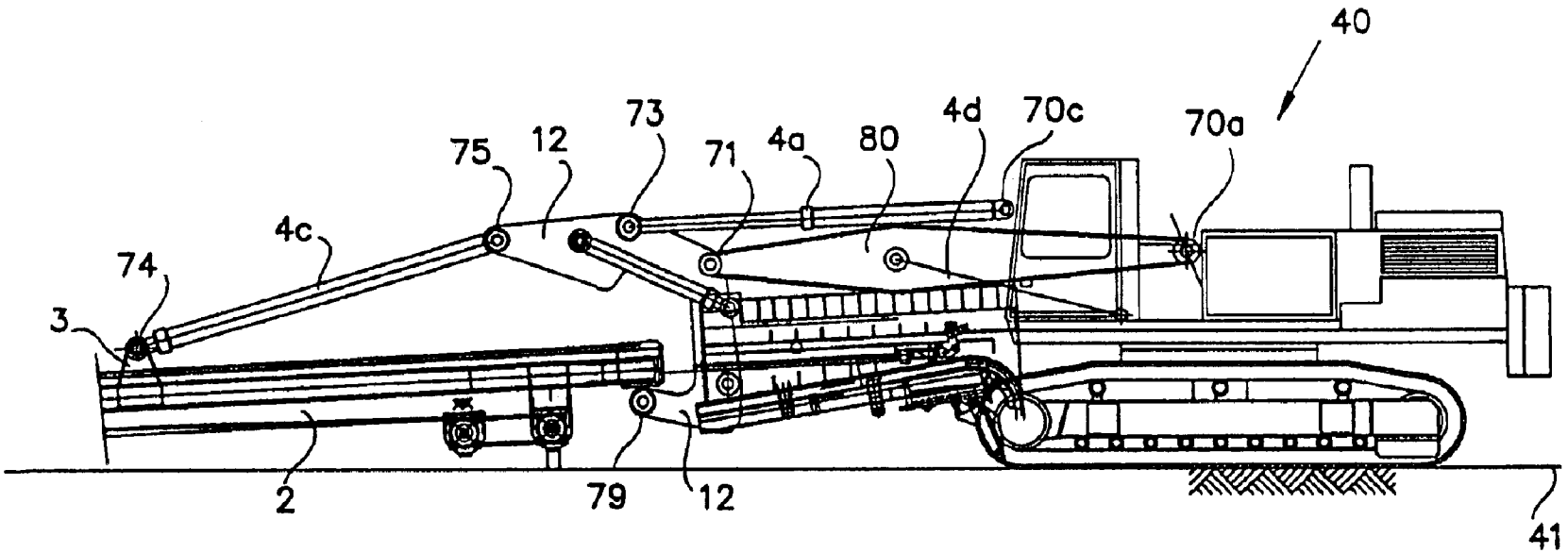

Due to the various hinges 70–79 and the piston/cylinder assemblies 4*a*–*d*, the machine 40, the arm or boom 110, the post 2 and the plough 6 may be set at different angles with respect to each other, as illustrated in FIGS. 1A–C. In the upright position of FIG. 1A the piston/cylinder assembly 4*d* has been extended, somewhat, and assembly 4*a* has been operated to maintain the orientation of bracket 12 as compared to FIG. 1. Two other positions have been indicated in FIG. 1A, that is for the post 2 a lying orientation by swinging the post 2 in direction S, realized by extending assembly 4*c*, and for the plough 6 a halfway swung back (direction T) orientation, realized by extending assembly 4*b*, all while maintaining the orientation of bracket 12. In FIG. 1B the post 2 has been left out, and the plough 6 has been swung to a horizontal orientation, while maintaining the orientation of bracket 12.

In FIG. 1C, piston/cylinder assemblies 4*a* and 4*d* have been operated to swing the post 2, the bracket 12 and the plough 6 as a unity from the orientation of FIG. 1 into a horizontal, transportation orientation.

Figure 2:
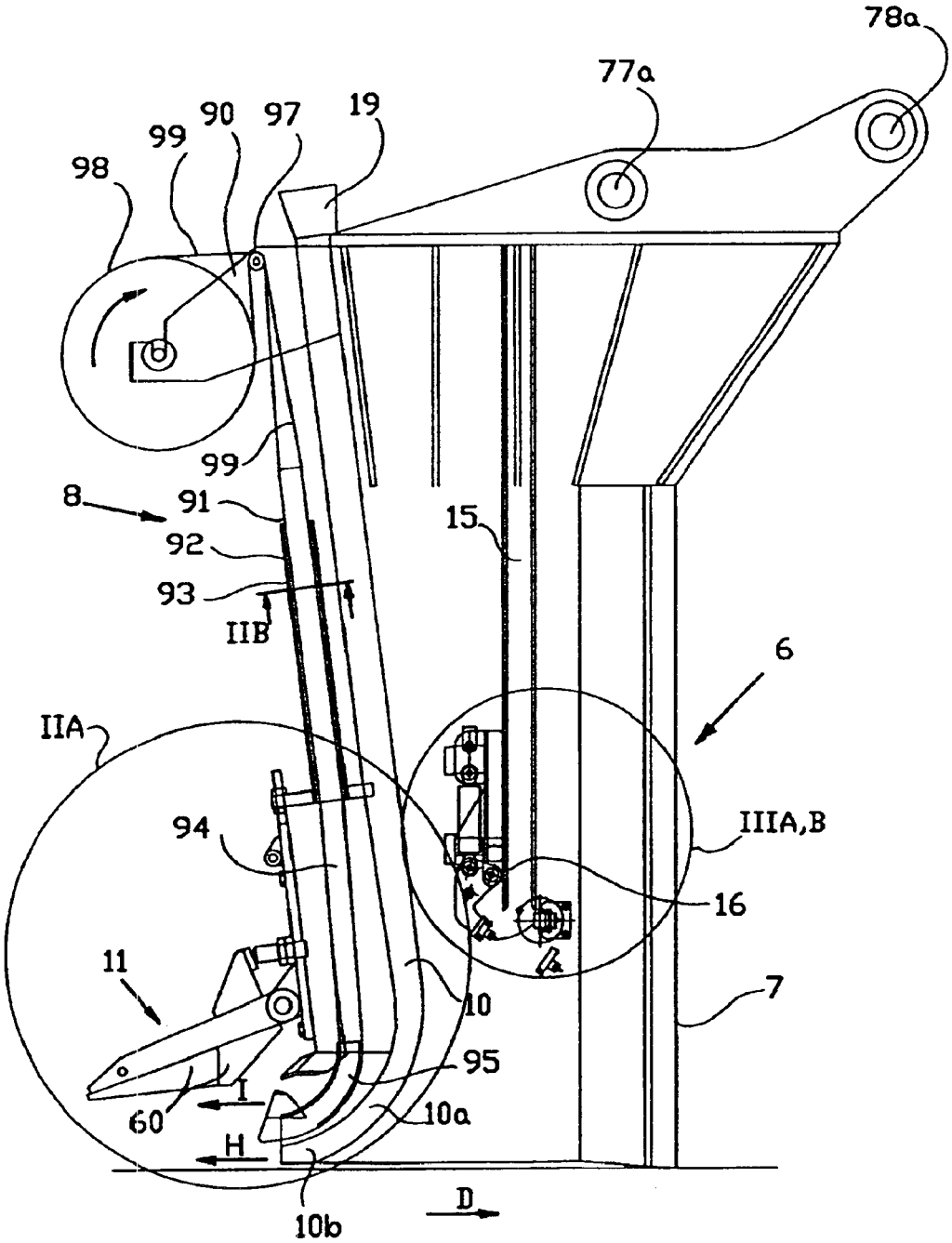
FIG. 2 is a partial side view of the preferred embodiment of the apparatus of the present invention showing the plough part of the apparatus.

Turning now to FIG. 2, at its front edge 7, the plough has a sharp front edge with flanks 7*a*, 7*b*. These flanks merge into side plates 113*a,b*, defining an inner space shielded from the soil and providing strength to the plough 6. In this inner space, the plough 6 is provided with a vertical passage 15, at the lower end of which a schematically indicated ribbon cutter 16 has been arranged, which in an exemplary embodiment is shown in detail in the FIGS. 3A and 3B.

Figure 3B:
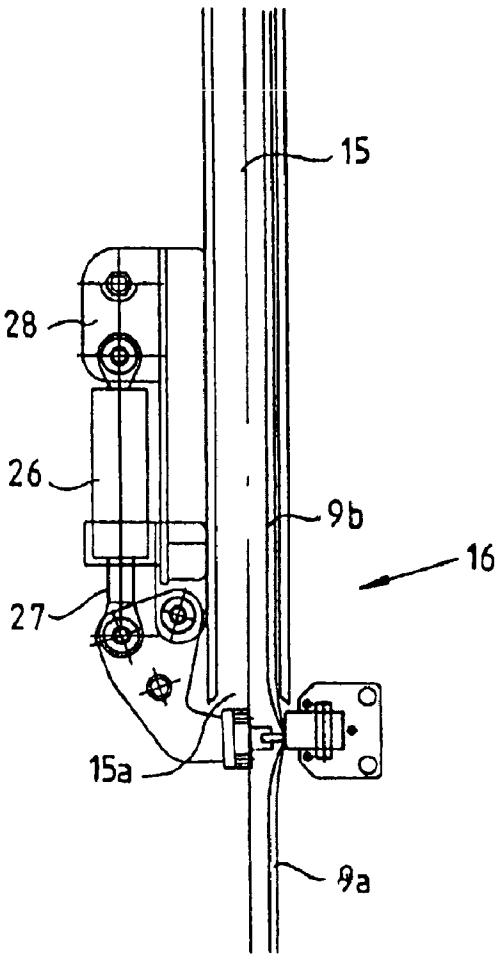
Figure 3A:
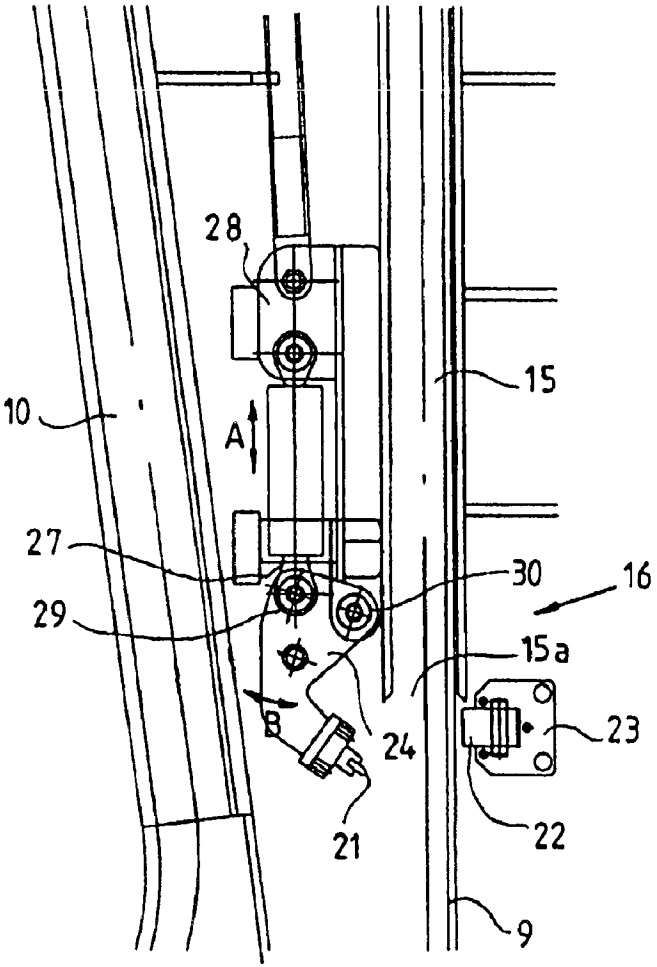

The cutting mechanism 16 shown in FIGS. 3A and 3B is arranged to be active at the lower end of vertical passage 15, near its lower opening 15*a*. FIG. 3A schematically shows a drainage ribbon 9 vertically extending through the passage 15, at the moment the lance has already been drawn and the drainage ribbon 9 therefore has been inserted into the ground sufficiently deep.

The ribbon cutting mechanism 16 comprises an anvil 22 attached in a holder 23 fixedly arranged on the plough 6, against which anvil a blade 21 can be brought with great force for cutting the drainage ribbon 9. The blade 21 has been attached to a lever 24, which is hingedly attached in the plough 6 at the location of pivot pin 30, and which by means of pin 29 has been attached to the end of a piston rod 27 of cylinder 26, which itself has been attached with the other end to an attachment block 28 fixedly arranged on the plough 6.

When a drainage ribbon 9 has to be cut through, the cylinder 26 is excited with means that are not further shown, so that the piston rod 27 is urged downwards in the direction A. As a result the pin 29 is moved downwards, in which as a result of the hinging attachment of the upper end of the cylinder 26 to the block 28 some deflection to the rear is possible, so that a fluent rotational movement about the pivot pin 30 is possible. Thus the lever 24 is rotated anti-clockwise in the direction B, until the blade 21, as can be seen in FIG. 3B, has separated the drainage ribbon 9 into a portion 9*a* that is left behind in the ground and a portion 9*b* that can be arranged at another location. The arrangement shown with vertical operation cylinder 26 and lever 24 for converting a vertical movement into a more or less horizontal cutting movement is efficient as regards occupation of space and power transmission.

At its upper side the plough 6 is provided with attachment eyes 77*a* and 78*a*, serving to accommodate hinges 77 and 78, respectively.

Figure 2A:
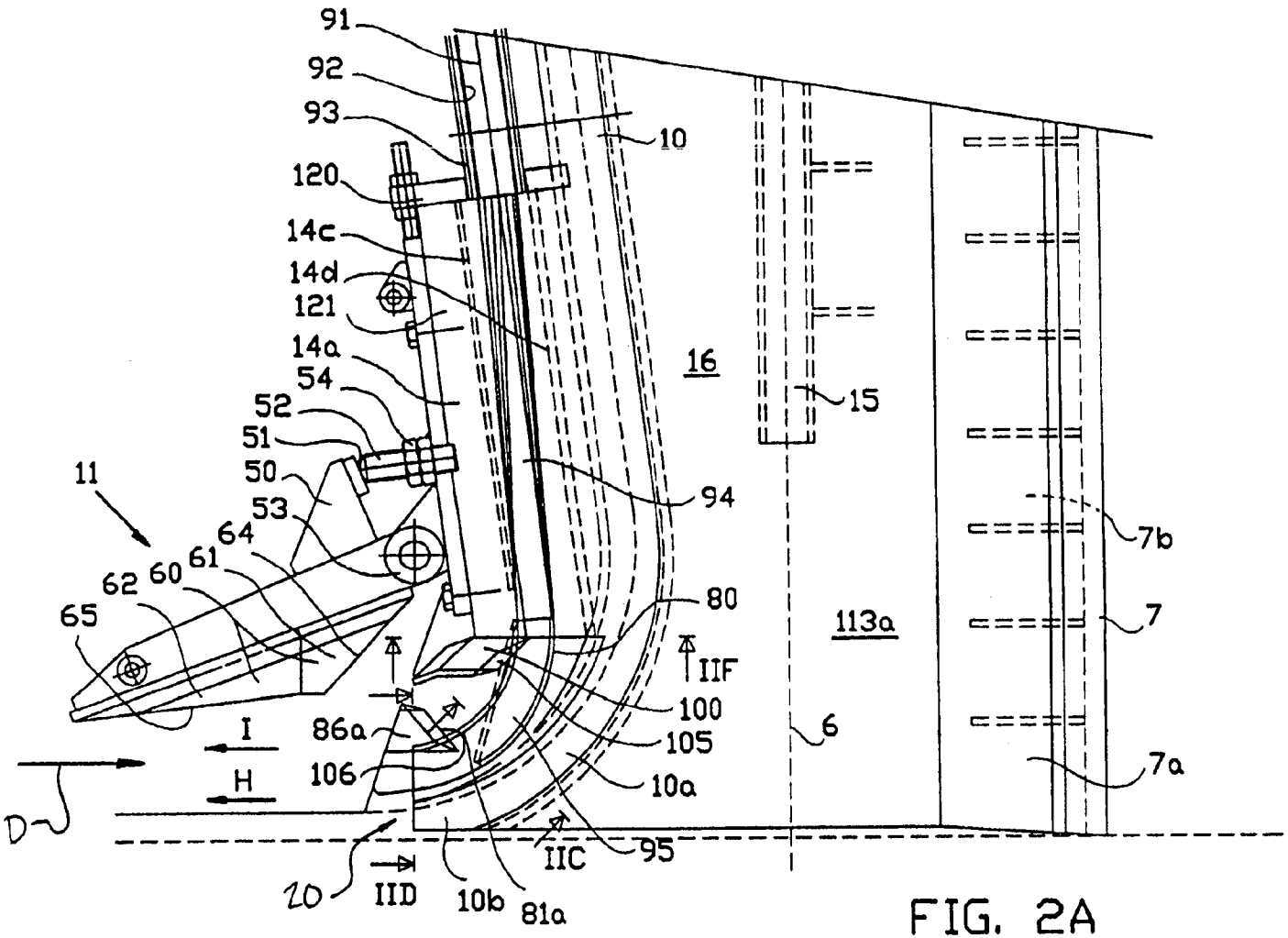
FIGS. 2A–H show several details and cross-sections, partially and schematically, of the plough part of FIG. 2.
Figure 2B:
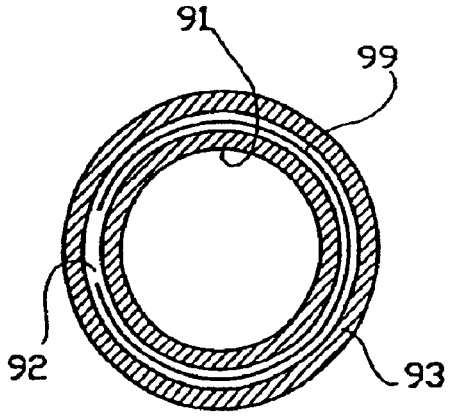
Figure 2G:
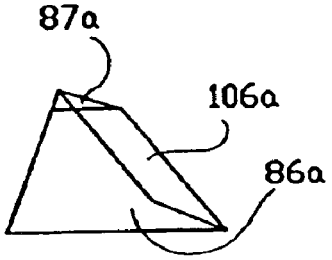
Figure 2H:
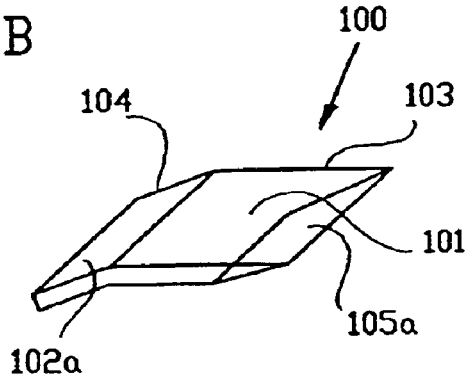
Figure 2E:
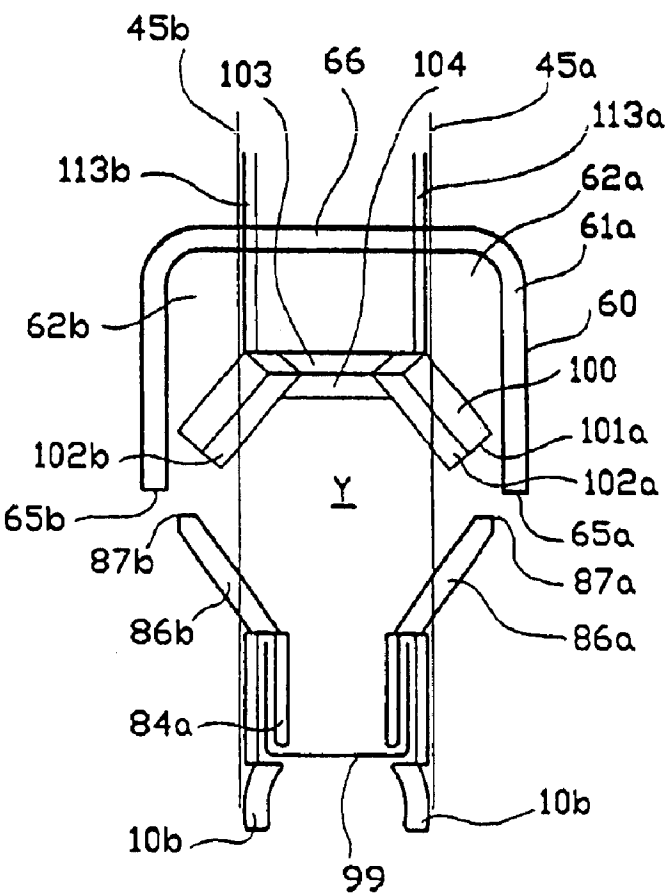
Figure 2D:
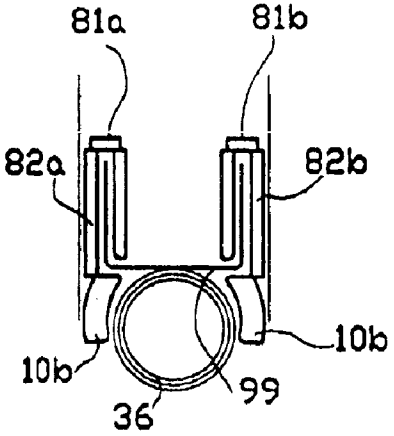
Figure 2C:
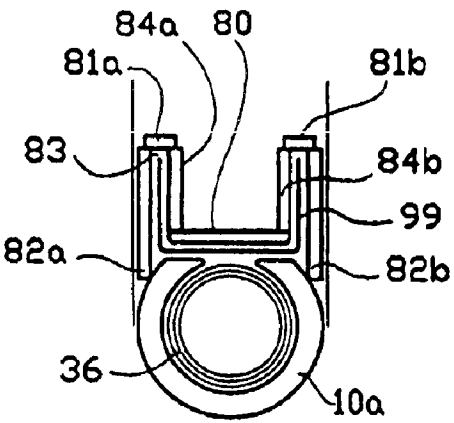

At the rear side 8, the plough 6 is provided with a pipe 10, having an entrance 19 at its upper end and a smoothly curved portion 10*a* at its lower end, which curved portion 10*a* is cut open in the upper portion of its circumference and ends in portion lob, where also the lower portion of its circumference has been cut away (notice the cross sections of FIGS. 2C and 2D). The end portion 10*b* is horizontally oriented and defines exit 20 which is oriented horizontally rearwards.

Parallel to pipe 10, directly rearwards of it, extends a supply for an air-tight sealing foil strip or sheet 99, when the application of such a foil would be needed. The supply comprises a support 90 for a supply roll 98 of a foil strip 99. The strip 99 is guided over idle roller 97 into a downward direction, where it engages about a pipe 91 having a circular cross-section. A small distance below pipe 91 a pipe 93 has been arranged about the pipe 91 to form an annular channel therewith for the foil strip 99 (see FIG. 2B).

Figure 2F:
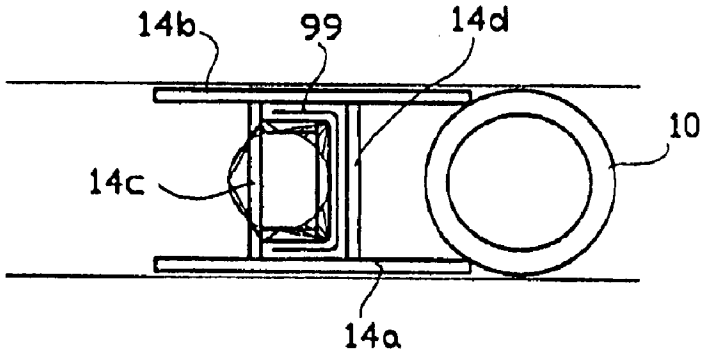

As can be seen in FIG. 2A, the lower ends of the circular pipes 91,93 are received in plate 120 which forms a part of bracket 121 that is fixed to the plough 6. Only the inner pipe 91 continues, and this pipe gradually merges into a U-shaped profile 94 realized at the lower end of bracket 121, just above the curved track 95. As can be seen in FIGS. 2A and 2F, the space around profile 94 is sidewardly bounded by plates 14*a,b*, to the rear by plate 14*c* and in front by plate 14*d*. The U-shaped profile 94 has a bottom 80 and two side walls 84*a,b*, as can be seen in the cross-section of FIG. 2C.

The side walls 14*a,b* are downwardly continued in curved downward extension plates 82*a,b* in curved track 95 to form a U-shaped channel 83 for the foil strip 99. As can be seen in FIG. 2C, this channel is delimited at its bottom by the pipe 10*a*, or, at pipe 10*b*, by the drainage pipe travelling through pipe 10 at the same speed.

Thus, in the downward direction of travelling, the foil 99 is transferred from a more or less circular shape into a U-shape, the legs of the U-shaped foil strip 99 being folded about the bottom 80 and the side walls 84*a,b* and being laterally confined by the downward extensions 82*a,b* of the plates 14*a,b*.

As can be seen in FIGS. 2, 2A, 2E and 2H, the plough 6 is provided with a pair of scraping blades 101,102, forming part of an inverted U-shaped scraper 100, attached to the lower end of the bracket 121 and defining a horizontal, upwardly confined passage Y (FIG. 2E). The scraper 100 has two inclined scraper blades 101, 102*a* and 101, 102*b* and upper wall 103/104, wherein the blades 102*a, b* and wall 104 converge towards each other and urge the soil flowing rearwards through the scraper 100 downward.

The scraping blades 101*a, b* have slanted front edges 105*a, b* (FIGS. 2A, 2E, 2H) which project sidewards from the plates 113*a*, 113*b* to cut soil from the walls (45*a*, 45*b* in FIG. 2E) of the trench made by the plough. This cut out soil will then be able to fall on the foil strip 99 that travels just below it. The scraper 100 may be left out in case no foil strip 99 is applied.

Below the scraper 100, the plough 6 is provided with a pair of blades 86*a*, 86*b* extending obliquely upwards and sidewards and having front edges 106*a*, 106*b* that are inclined upwards and rearwards and upper edges 87*a*, 87*b* (FIGS. 2A, 2E and 2G). These blades 86*a*, 86*b* make a cut into the walls of the trench made by the plough in order to make an incision or discontinuity in these walls, so that the stability of the walls below the incision may not be affected by the soil scraper and presser 11 yet to be described, which is active on the soil above the incision.

Reference is made to FIGS. 2 and 2A, in which the soil scraping and pressing and soil filling blades 11 attached to the rear 8 of the plough 6 has been illustrated. The soil scraper/presser 11 is positioned behind the scraper 100 and the blades 87*a*, 87*b*. It regards a substantially inverted U-shaped pressing profile 60, which at its front at the location of hinge 53 is hingedly attached to the plough 6, in particular bracket 121. At its upper side, the profile 60 is provided with a block 50 with stop 51 which abuts against a stop bolt 52 threadingly attached to bracket 121 by means of a pair of nuts 54. By adjusting the nuts 54 the length of projection of bolt 52 can be adjusted, and therewith the angle of orientation of the profile 60 with respect to the plough 6. The profile 60 has two legs 61*a*, 62*a* and 61*b*, 62*b* and an upper wall 66, wherein the upper wall 66 is inclined rearwards and downwards, and the leg portions 62*a*, 62*b* converge to each other, so as to define a narrowing passage or tunnel for the soil. As can be seen in FIGS. 2A and 2E, the edges 64,65 of the legs 61, 62 are downwardly and rearwardly inclined. The level of the edges 65*a,b* is just below the level of the lower edges of blade legs 101,102. The wall 66, and therewith the legs 61, 62, however, extend laterally beyond the blade legs 101, 102 and the blades 86*a*, 86*b*.

Moreover, the level of the edges 65*a*, 65*b* is slightly higher than the level of the upper edges 87*a*, 87*b* of the blades 86*a*, 86*b*.

Figure 5:
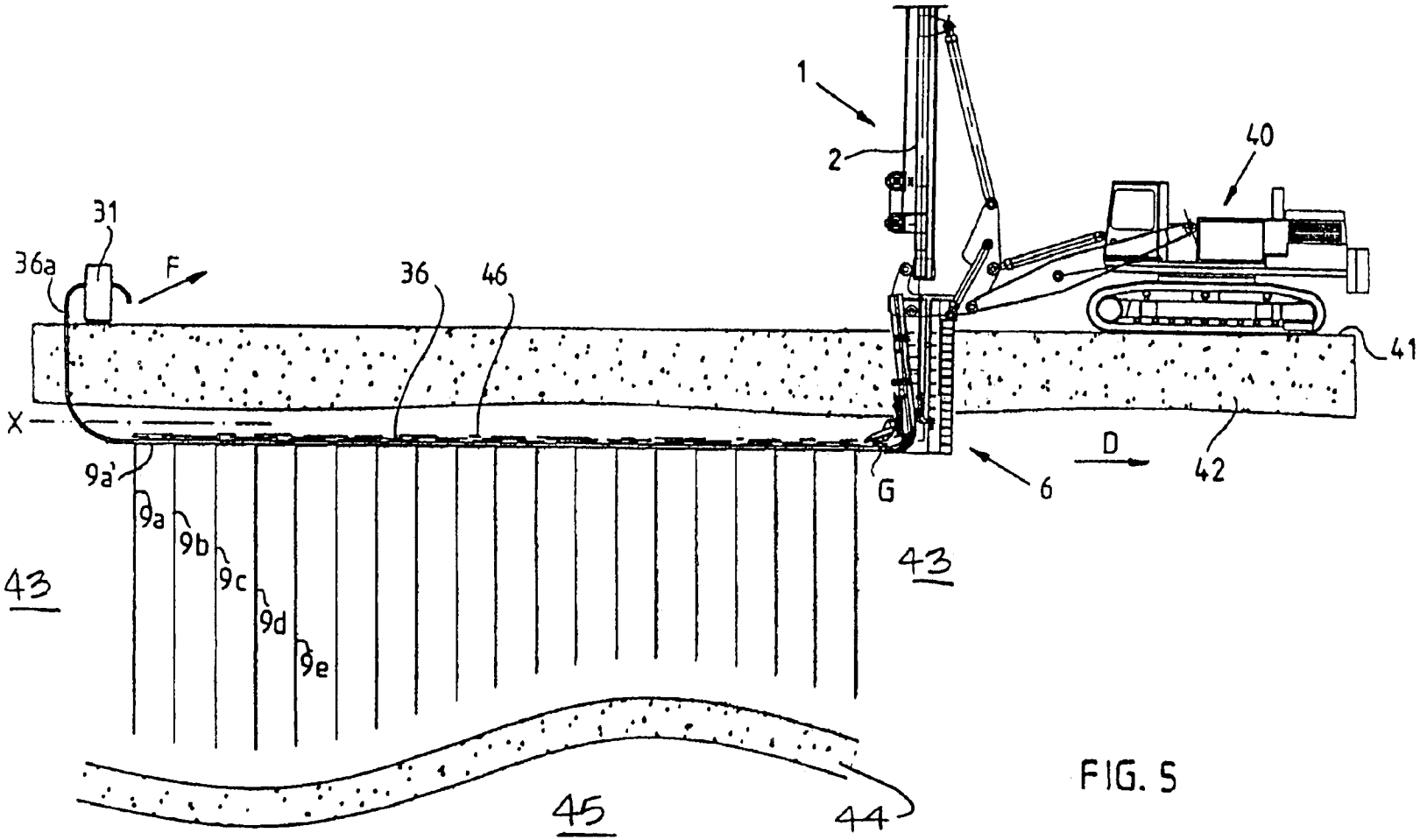
FIG. 5 schematically shows a project carried out with an apparatus according to the invention.

In FIG. 5 a picture at a given moment is given of a project in which the apparatus according to the invention is being used. The excavating machine 40 holds the kings post 2 straight up and provides the necessary power and operation lines. The project was started on the left-hand side in the drawing. The hydraulic machine 40 has moved itself over the ground level 41, underneath which a sand layer 42 is situated. At larger depth a sand layer 44 is situated between relatively weak—for instance clay or loamy—earth strata 43 and 45. In order to be able to carry out a project, such as the construction of a rail road or motorway, at the ground level it is necessary to reinforce the earth stratum 43, which takes place by accelerated consolidation, by letting water present in the layer 43 escape from it. This technique is known per se.

One starts by rotating (direction T) the plough 6 from the position shown left in FIG. 1B to a vertical position, during which movement the plough is able to penetrate the soil. A plough nose may be an aid here. If required a small excavation may be made locally. The plough 6 may have a height of several meters (for example, 2 meters or more), in any case sufficient to amply extend into the earth stratum 43.

When the plough 6 has been brought on the right location for arranging a vertical drainage ribbon, the apparatus is operated to press a drainage ribbon 9*a* in the earth stratum 43 by means of lance 5, down to the wanted depth. The lance 5 need not penetrate the sand layer 42 here, but instead easily penetrates the free passage 15 within the plough 6. After the lance 5 has been lifted again and the drainage ribbon 9 has been cut through by the cutting mechanism at about the level of line X in FIG. 5, the machine 40 is driven one step backwards, in which the plough 6 is pulled along in the direction D, while making a trench. During that movement a bendable drainage pipe 36 is supplied from a supply that is not further shown on king post 2, in which the pipe moves through the passage 10, 10*a*, 10*b* and exits from the horizontally oriented opening 20 in the direction H (see FIG. 2A). The end of the perforated drainage pipe 36 is connected to an unperforated pipe portion 36*a*, which leads to a deep well pump 31 above ground level, which later on is able to discharge water (and air) in the direction F. The supplying of the drainage pipe 36 at the rear side of the plough 6 is relative: the drainage pipe that is already in the trench remains there, and the plough moves in the direction D.

At the next location where a drainage ribbon has to be arranged, one proceeds as with drainage ribbon 9*a* and thus the drainage ribbons 9*b*, 9*c*, 9*d*, 9*e* etc. are arranged stepwise. With all interim movements in the direction D the horizontal drainage pipe 36 is extended stepwise, until the situation shown in FIG. 4 has been reached. During the movements, the part of the drainage ribbon that extends between the cutting mechanism 16 and the lower side of the plough 6 is horizontally spread on the trench bottom as a result of engaging against the outer bend 10*a* of the passage 10, and on the thus horizontally turned portion 9*a*' (see FIG. 5) the horizontal drainage pipe 36 has come down, as a result of which a direct contact between both drainage elements is possible for quick passing on of water. When the wanted end of the horizontal extension of the pipe 36 has been reached, the pipe can be cut at depth and sealed at the end or connected to a perforated pipe portion that is connected to a second pump, so that in case of larger drainage lengths water can be discharged in two directions.

Alternatively this connection can be realised in a casing of granular material. To that end, simultaneously with either the drainage pipe or with a separate pipe, a granular material is supplied via pipe 10 to a space formed by lower side plough, bend 10*a* and the vertical ribbon.

In order to let the drainage arrangement be as efficient as possible, use is made of an underpressure system in which according to the invention it is prevented that false air is being drawn in, particularly in the area above the drainage pipe. In order to let the drainage pipe be active as much as possible in downward direction, the contact area with the drainage ribbons, first an incision is made in the trench wall by means of the blades 86*a,b*, after which the U-blade 60 extends with horizontal portion 66 in those incisions made and soil material below there in the trench wall is cut vertically by the legs 61*a, b* and after that is removed from the trench wall by the converging legs 62*a*, 62*b* and urged downwards by wall 66. During the movement steps in the direction D of the plough 6, the material is thus pressed and compacted on and around the upper half of the circumference of the horizontal drainage pipe 36 by the pressing blade 60, so that an as it were airtight layer 46 is situated on the pipe 36. The reversed U-shape of blade 60 and the stop 52 here promote the realization of the airtight sealing.

When the work has been completed the plough 6 can be removed from the trench by tilting about hinge 77, alternatively, the assembly of plough 6, bracket 12 and post 2 can be lifted. In that case, the hinged connection of the scraper/presser 11, 60 at 53 permits the scraper/presser 11, 60 to rotate towards a more vertical orientation in which the lifting movement is facilitated. In addition, by such an orientation it is avoided that the walls of the trench are severely damaged, which would otherwise result in local collapse of these walls and loosened soil falling on the drain, due to which a leakage path might be realized.

In case the type of soil is less cohesive or substantially granular, the foil 99 can be used to provide an air tight seal on the pipe 36. Here, the scraper 100 and the parts for the supply of the foil strip 99 are used, the strip 99 being supplied at the same speed as the drainage pipe 36 in the direction I and H, respectively (FIGS. 2 and 2A). The scraper cuts the soil from the trench walls, crumbles it and urges it downwards to let it fall on the foil strip 99 which is then already more or less horizontal. Thus it is ensured that the strip has a proper position on the upper side of the drainage pipe before the pressing and filling blade 60 becomes active in the area concerned. The foil 99 used can be a composite one, such as a sandwich foil of an upper layer and a lower layer of polypropylene for strength, and an air tight foil in between these layers.

When making the trench the plough can be hindered by high density types of soil, or by obstacles of a natural or artificial nature. In order to remove or minimize that hinder the plough can be equipped with means known per se for breaking off the cohesion of the soil and/or obstacles or displacing them. In one embodiment the plough at its front edge 7 is provided with one or several blades that are vertically movable over the entire height of the cut surface. When necessary these blades make an upward and downward movement.

Alternatively for making the trench, the trench-making device can be provided with a ground cutter in the portion in front of a vertical passage of the lance/the ribbon. It strongly resembles a chain saw and may consist of an endless chain which may or may not be provided with teeth and/or scrapers. A chain here runs in the centre of the device about a drive wheel at the upper side of the device to a turn wheel at the lower side of the device. The shafts of the chain wheels are perpendicular to the direction of travel of the device whereas the chain runs in the plane of the direction of movement of the device. Here the device is furthermore provided with the means described earlier on for supplying the pipe and possibly the U-shaped soil closing blades.

The movement of the chain may take place in continuous rotating movement or in an up and downwardly oscillating movement. In a special embodiment several chains may run side by side possibly having an opposing direction of movement.

Alternatively the plough can be provided with one or several vibrating mechanisms to let the plough make a pulsating movement in the propelling movement as well as transverse to it.

It is noted that the methods discussed can also be used from a pontoon on a subaqueous soil.

PARTS LIST

The following is a list of suitable parts and materials for the various elements of the preferred embodiment of the present invention.

Part No. Description

1 apparatus
2 kings post
3*a* bracket
3*b* bracket
4*a* piston ylinder ssembly
4*b* piston cylinder assembly
4*c* piston cylinder assembly
4*d* piston cylinder assembly
5 lance
6 plough
7 front edge
7*a* flank
7*b* flank
8 rear side
9 drainage ribbon
9*a* ribbon
9*a*' horizontally turned portion
9*b* ribbon
9*c* ribbon
9*d* ribbon
9*e* ribbon
10 pipe
10*a* curved pipe portion
10*b* pipe end portion
11 soil scraper/presser
12 u-shaped bracket
14*a* plate
14*b* plate
14*c* plate
14*d* plate
15 vertical passage
15*a* lower opening
16 ribbon cutting mechanism
19 entrance
20 exit
21 anvil blade
22 anvil
23 holder
24 lever
26 cylinder
27 piston rod
28 attachment block
29 pin
30 pivot pin
31 deep well pump
36 drainage pipe
36*a* unperforated portion
37 plate
38 u-shaped bracket
39 anchoring lips
40 excavating machine
41 ground level
42 sand layer
43 earth stratum
44 sand layer
45*a* wall
45*b* wall
46 airtight layer
50 block
51 stop
52 stop bolt
53 hinge location
54 nut
60 presser
61 leg
61*a* leg
61*b* leg
62 leg
62*a* leg
62*b* leg
64 edge
65 edge
65*a* edge
65*b* edge
66 upper wall
70*a* hinge
70*b* hinge
70*c* hinge
71 hinge
72 hinge
73 hinge
74 hinge
75 hinge
76 hinge
77 hinge
77*a* attachment eye
78 hinge
78*a* attachment eye
79 hinge
80 bottom
82*a* curved downward extension plate
82*b* curved downward extension plate
83 u-shaped channel
84*a* side wall
84*b* side wall
86*a* blade
86*b* blade
87*a* upper edge
87*b* upper edge
90 support
91 inner pipe
93 pipe
94 u-shaped profile
95 curved track
97 idle roller
98 supply roll
99 foil strip
100 scraper
101 scraping blade
101*a* scraping blade

101*b* scraping blade
102 scraping blade
102*a* scraping blade
102*b* scraping blade
103 wall
104 wall
105*a* slanted front edge
105*b* slanted front edge
106*a* front edge
106*b* front edge
110 boom
113*a* side plate
113*b* side plate
120 plate
121 bracket
A direction arrow
B direction arrow
D direction arrow
F direction arrow
H direction arrow
J direction arrow
K direction arrow
L direction arrow
M direction arrow
p direction arrow
S direction arrow
T direction arrow
X line
Y passage The foregoing embodiments re presented by way of example only; the scope of the present invention is to be limited only by the following claims.

What is claimed is:

1. A method for consolidating an earth stratum situated in a subgrade by withdrawing water from the subgrade comprising the steps of:

a) placing a plurality of generally vertically positioned drains in the earth stratum;

b) connecting the drains with a generally horizontally extended drain to provide water transfer between them;

c) forming an air sealing layer directly over the generally horizontal drain and the closing of the surface of the soil;

d) connecting the generally horizontal drain to a pump; and e) discharging fluid from the generally horizontal drain using the pump.

2. The method of claim 1, in which a trench is made from the ground surface and the vertical drains extend downwardly from the bottom of the trench.

3. The method of claim 2, in which the trench is formed with a plough supported by a mobile carnage device and the vertical drains are positioned during use by means of said device and the horizontal drain each time being arranged after that until the next vertical drain has to be arranged.

4. The method of claim 3, in which simultaneously with the arrangement of the horizontal drain or immediately after that, the air sealing layer is being arranged by means of the device.

5. The method of claim 4, in which the air sealing layer is arranged by removing soil material from the trench walls and arranging it on the horizontal drain.

6. The method of claim 4, in which the air sealing layer is arranged by arranging a sealing foil layer on the horizontal drain.

7. The method of claim 4, in which the air sealing layer is arranged by arranging a sealing layer of plastic material on the horizontal drain.

8. The method of claim 7 wherein the plastic material is bentonite.

9. The method of claim 1, performed on a subaqueous soil.

10. The method of claim 1 in which the trench is finally closed off with soil material up to approximately the original surface.

11. The method of claim 1 in which the vertical drains are taken from a supply and after each strip has been arranged are separated by cutting through at a level above the trench bottom.

12. The method of claim 10, in which the cutting through takes place in the device.

13. A soil consolidation apparatus for consolidating a selected earth stratum, comprising:

a) a movable carriage;

b) means for the stepwise supplying of vertical drains from a supply and driving each said drain into the earth stratum; and c) means for supplying and laying a horizontal drain in which the horizontal drain is applied in fluid communication with upper ends of the supplied vertical drains.

14. The soil consolidation apparatus of claim 13, further comprising means for cutting through drainage ribbon at a selected level.

15. The soil consolidation apparatus of claim 14, in which the means for cutting through includes a movable blade and an anvil for said blade.

16. The soil consolidation apparatus of claim 15 in which the blade has been arranged on a first arm of a lever rotatable about a horizontal center line, a second arm of said lever being connected to a hydraulic cylinder.

17. The soil consolidation apparatus of claim 13 further comprising means for making a trench from the grond surface down to at least the upper side of the earth stratum to be consolidated.

18. The soil consolidation apparatus of claim 17 in which the trench-making means includes a plough.

19. The soil consolidation apparatus of claim 18, in which at its rear side the plough is provided with means for removing soil material from the trench walls and for pressing it downward.

20. The soil consolidation apparatus of claim 18 in which at its rear side the plough is provided with means for supplying the horizontal drain, from a supply roll.

21. The soil consolidation apparatus of claim 18 furthermore provided with means for pivoting the plough about a horizontal axis of rotation, between a trench-making active position and an upwardly tilted moving position.

22. A method for consolidating an earth stratum situated in a subgrade by withdrawing water from the subgrade comprising the steps of:

a) placing a plurality of generally vertically positioned drains in the earth stratum;

b) connecting the drains with a generally horizontally extended drainpipe to provide water transfer between them;

c) forming an air sealing layer directly over the generally horizontal drain pipe and the closing of the surface of the soil;

d) connecting the generally horizontal drain pipe to a pump; and e) discharging fluid from the generally horizontal drain pipe using the pump.

23. A soil consolidation apparatus for consolidating a selected earth stratum, comprising:

a) a movable carriage having a drive for driving the carriage over a ground surface;

b) means for making a trench from the ground surface down to at least the upper side of the earth stratum to be consolidated;

c) means for the stepwise supplying of vertical drains from a supply and driving each said drain into the earth stratum; and d) means for supplying and laying a horizontal drain in which the horizontal drain is applied in fluid communication with upper ends of the supplied vertical drains.

* * * * *